US010392754B2

(12) United States Patent
Nguyen et al.

(10) Patent No.: US 10,392,754 B2
(45) Date of Patent: Aug. 27, 2019

(54) RECESSED CONCRETE RAIL SEAT ASSEMBLY

(71) Applicant: PROGRESS RAIL SERVICES CORPORATION, Albertville, AL (US)

(72) Inventors: Thai Nguyen, De Soto, KS (US); Jose Ricardo Mediavilla, Kansas City, MO (US)

(73) Assignee: Progress Rail Services Corporation, Albertville, AL (US)

( * ) Notice: Subject to any disclaimer, the term of this patent is extended or adjusted under 35 U.S.C. 154(b) by 8 days.

(21) Appl. No.: 15/560,268

(22) PCT Filed: Apr. 6, 2016

(86) PCT No.: PCT/US2016/026188
§ 371 (c)(1),
(2) Date: Sep. 21, 2017

(87) PCT Pub. No.: WO2016/164443
PCT Pub. Date: Oct. 13, 2016

(65) Prior Publication Data

US 2018/0073199 A1 Mar. 15, 2018

(30) Foreign Application Priority Data

Apr. 9, 2015 (AU) ..... 2015901265

(51) Int. Cl.
*E01B 9/30* (2006.01)
*E01B 9/48* (2006.01)
*E01B 9/68* (2006.01)

(52) U.S. Cl.
CPC ..... *E01B 9/685* (2013.01); *E01B 9/303* (2013.01); *E01B 9/483* (2013.01); *E01B 9/68* (2013.01); *E01B 2205/00* (2013.01)

(58) Field of Classification Search
CPC ... E01B 9/68; E01B 9/685; E01B 9/30; E01B 9/303; E01B 9/483; E01B 9/60
See application file for complete search history.

(56) References Cited

U.S. PATENT DOCUMENTS 3,395,864 A 8/1968 Kuster
6,367,704 B1 * 4/2002 Mediavilla ..... E01B 9/306 238/310

(Continued)

FOREIGN PATENT DOCUMENTS

GB 739432 10/1955
GB 1427974 3/1976

(Continued)

OTHER PUBLICATIONS

Corresponding International Search Report and Written Opinion for PCT/US2016/026188 dated May 30, 2016. WO.

*Primary Examiner* — Jason C Smith
(74) *Attorney, Agent, or Firm* — Bookoff McAndrews

(57) ABSTRACT

A low maintenance rail seat has recess in the concrete tie and an abrasion plate that covers the floor of the recess and its sides parallel to the rail base. The abrasion plate includes ribs which seat in additional recesses in the tie to retard longitudinal movement. The anti-abrasion assembly preferably has four flanges which wrap around the top of concrete tie to prevent dust particles from entering and abrading the concrete rail seat. These flanges also wrap around the support shoulder for additional resistance to longitudinal movement. The components are designed to provide 8.5" of lateral support along the side of the rail base while the traditional e clip fastener provides only 3" of lateral support. The interlock feature between the anti-abrasion assembly and the concrete tie also minimizes relative movement between abrasion plate and concrete tie, which results in less concrete surface abrasion.

20 Claims, 6 Drawing Sheets

(56) References Cited

U.S. PATENT DOCUMENTS

| | | | | |
|---|---|---|---|---|
| 2003/0080195 | A1* | 5/2003 | Mediavilla | E01B 9/306<br>238/315 |
| 2008/0203181 | A1* | 8/2008 | Young | E01B 9/303<br>238/351 |
| 2012/0031992 | A1* | 2/2012 | Mediavilla | E01B 9/30<br>238/351 |
| 2013/0015256 | A1 | 1/2013 | Bednarczyk et al. | |
| 2013/0206854 | A1 | 8/2013 | Bosterling et al. | |
| 2015/0083816 | A1* | 3/2015 | Young | E01B 9/303<br>238/351 |

FOREIGN PATENT DOCUMENTS

| | | |
|---|---|---|
| GB | 2095311 | 3/1981 |
| WO | 2001073203 | 3/2000 |
| WO | 2013186520 | 12/2013 |

* cited by examiner

RECESSED CONCRETE RAIL SEAT ASSEMBLY

PRIORITY

Priority is claimed as a national stage application, under 35 U.S.C. § 371, to international patent application No. PCT/US2016/026188, filed Apr. 6, 2016, which claims priority to Australian patent application 2015901265, filed Apr. 9, 2015. The disclosures of the aforementioned priority applications are incorporated herein by reference in their entirety.

This invention relates to improvements in rail seat assemblies with concrete ties and cast in support shoulders.

BACKGROUND TO THE INVENTION

Heavy haul railroad track in the USA has been experienced wide gauge and rail seat abrasion due to insufficient lateral and longitudinal support from the side and the bottom of the rail. Frequent maintenance is required to keep the track in good condition.

U.S. Pat. No. 4,757,945 discloses a sleeper with a recessed rail seat and further recesses in the rail seat to accommodate the feet of a rail insulator interposed between the shoulder and the rail base.

USA patent application 2011/0047786 discloses a guide plate used in conjunction with an abrasion plate on the rail seat.

It is an object of this invention to provide a rail seat that requires less maintenance.

BRIEF DESCRIPTION OF THE INVENTION

To this end the present invention provides a rail seat which includes a rail tie a rail abrasion plate an elastic rail clip and a rail clip support shoulder wherein the rail tie has a recessed rail seat with additional recesses to accommodate ribs on the lower surface of said abrasion plate said ribs being configured to seat in the additional recesses and provide a wider lateral support for the rail and retard longitudinal movement.

This invention is predicated on the insight that the e clip fastening rail seats have an inadequate area bearing against the longitudinal edges of the rail base. At present the contact is the width of the rail clip support shoulder. The improvement is achieved by providing a recess in the concrete tie and an abrasion plate that covers the floor of the recess and its sides parallel to the rail base. The abrasion plate includes ribs which seat in additional recesses in the tie to retard longitudinal movement. The anti-abrasion assembly preferably has four flanges which wrap around the top of concrete tie to prevent dust particles from entering and abrading the concrete rail seat. These flanges also wrap around the support shoulder for additional resistance to longitudinal movement. The new fastening components are designed to provide 8.5" of lateral support along the side of the rail base while the traditional e clip fastener provides only 3" of lateral support.

The clip provides the clamping force to the rail base through the heavy duty insulator.

The interlock feature between the anti-abrasion assembly and the concrete tie also minimizes relative movement between abrasion plate and concrete tie, which results in less concrete surface abrasion. The new fastening system is expected to provide longer component service life and less track maintenance.

In another aspect this invention provides a shoulder with a deep front rib which sits flush with the concrete rail seat to allow the anti-abrasion assembly and concrete tie to provide lateral full bearing to the rail. This preferred shoulder has a distance from the top of the clip tunnel to the top of the front rib which is 5 times the distance from the top of the clip tunnel to the clip heel surface.

Preferably the shoulder has a rectangular recess which interlocks with the anti-abrasion plate assembly and hold it in place before and during track installation.

DETAILED DESCRIPTION OF THE INVENTION

A preferred embodiment of the invention will be descried with reference to the drawings in which FIG. 1 shows the complete fastening system assembled in a rail seat;

Figure 1:
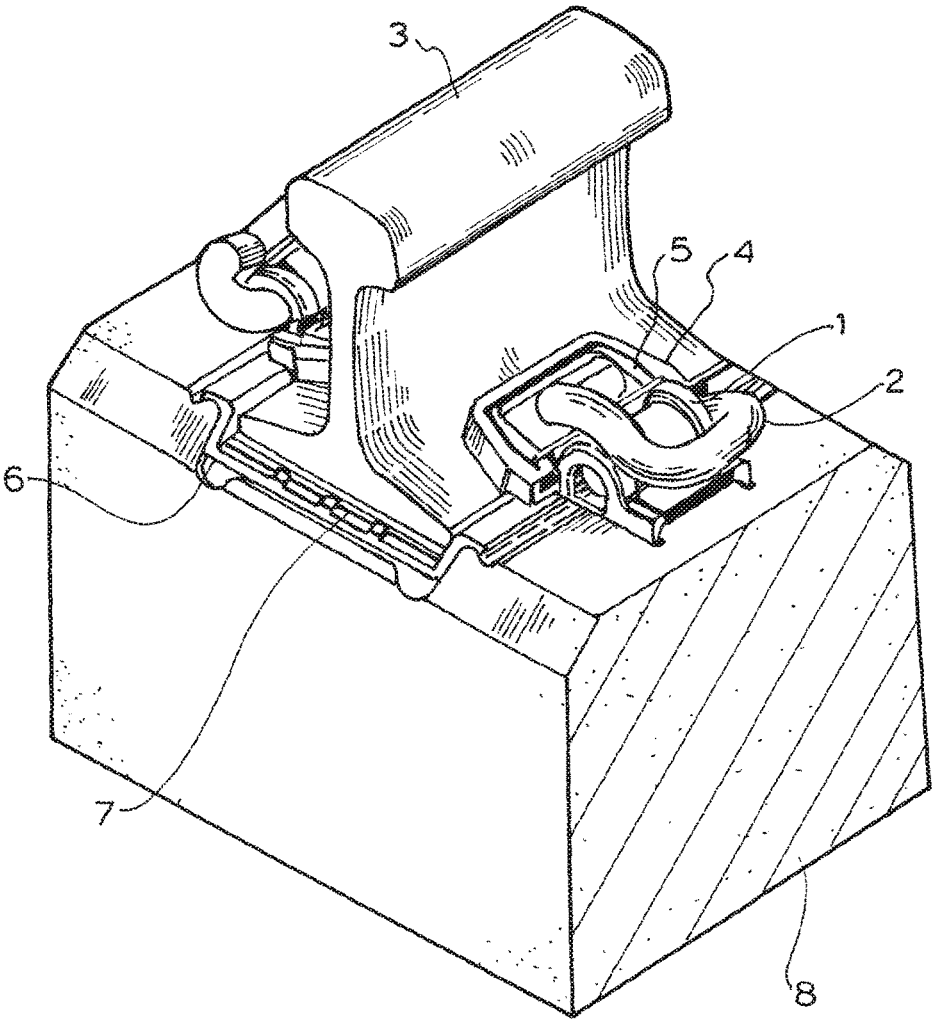

FIG. 1 shows the complete fastening system assembled in a rail seat section of the concrete tie 8. The rail 3 is supported in the bottom by the rail pad 7 and the anti-abrasion plate 6, supported on the sides by the anti-abrasion plate's side post 18. The rail base is clamped on top by the heavy duty insulator liner 4 and steel insert 5, the clamping force is provided by clip 2. The clip is supported by shoulder 1 which is cast in the concrete tie 8.

Figure 2:
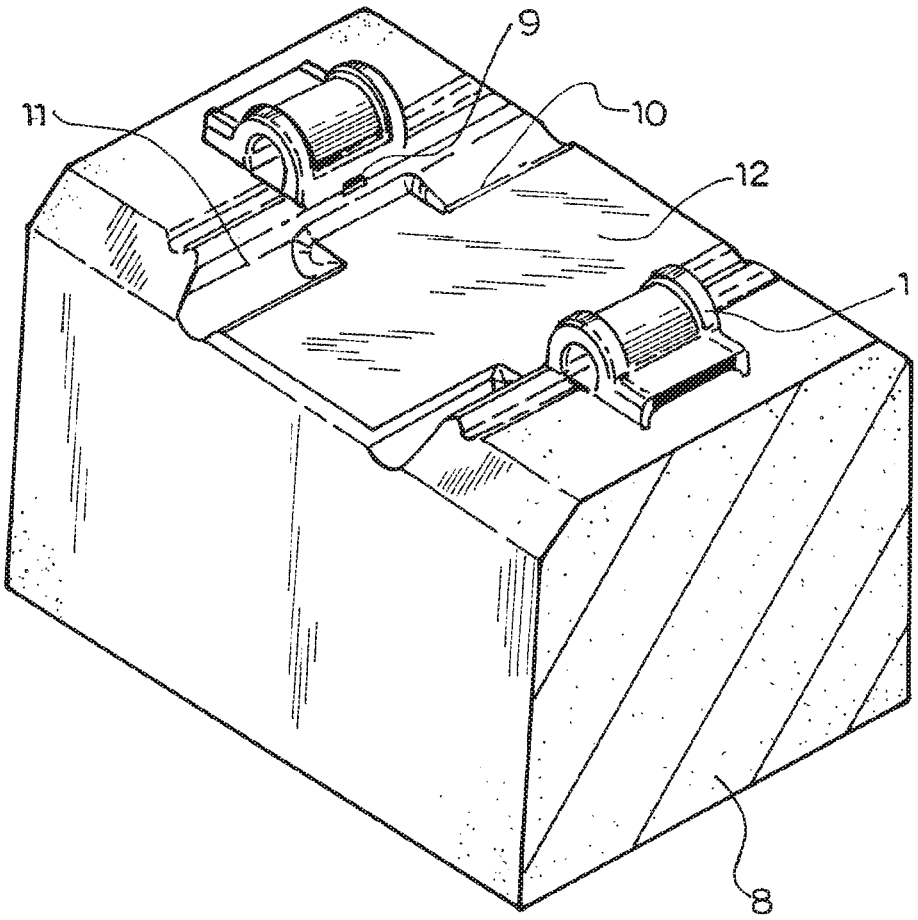
FIG. 2 shows the concrete tie with a cast in shoulder.

FIG. 2 shows the concrete tie 8 with cast in shoulder 1. The shoulder 1 has a rectangular slot 9 which interlocks with anti-abrasion plate lip 15 and holds the anti-abrasion plate assembly in the rail seat prior to track installation. The concrete tie rail seat 12 has deep channels 10 and side wall 11 to support the anti-abrasion plate assembly in the vertical, longitudinal, and lateral direction.

Figure 3:
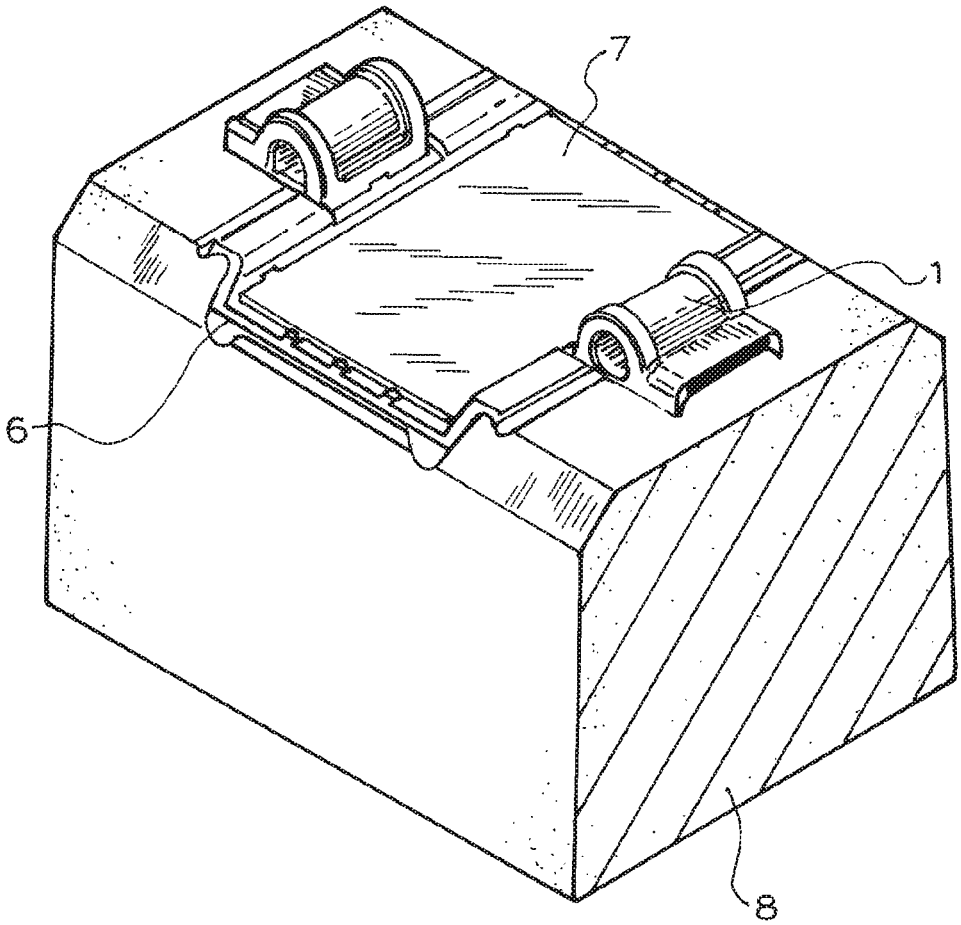
FIG. 3 shows the anti-abrasion plate assembly pre-assembled in the concrete tie.

FIG. 3 shows the anti-abrasion plate assembly pre-assembled in the concrete tie before track installation. The anti-abrasion plate assembly is held captive in the rail seat before rail laying, eliminate the need for manual pad placement.

Figure 4:
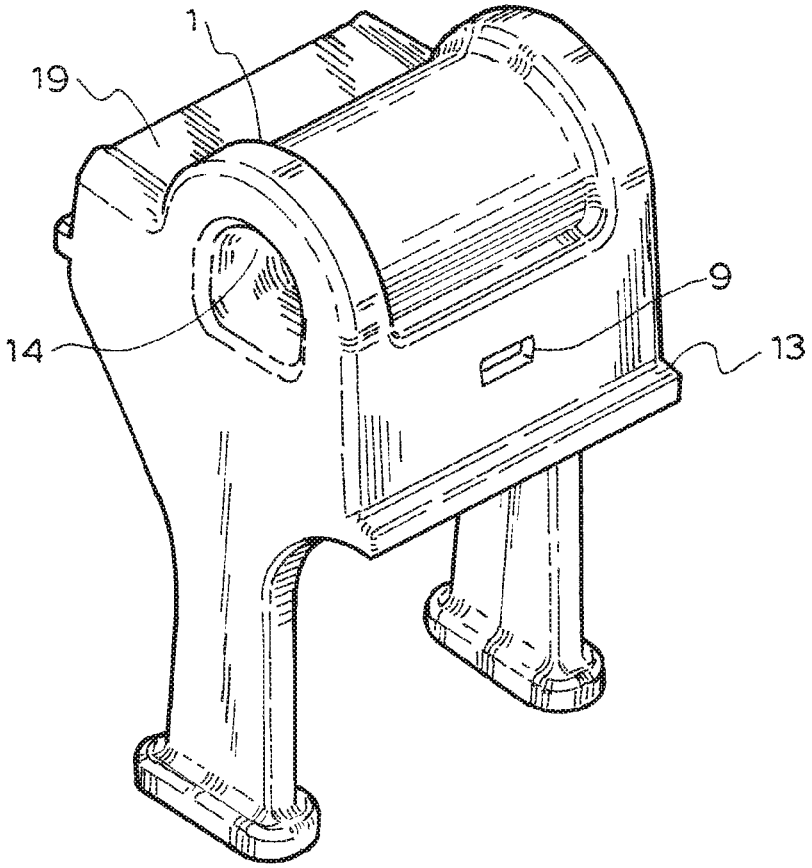
FIG. 4 shows the preferred shoulder of this invention.

FIG. 4 shows the newly designed shoulder 1. This shoulder has a rectangular slot 9 to hold the anti-abrasion plate lip 15, front rib 13 which is positioned flush with the concrete rail seat 12. The distance from the rib 13 to the top of the shoulder tunnel 14 is 44.5 mm, five times the distance from the clip heel surface 19 to the top of the tunnel 14. This unique geometry allows the anti-abrasion assembly to sit low in the concrete rail seat and provide the full lateral bearing length of 8.5".

Figure 5:
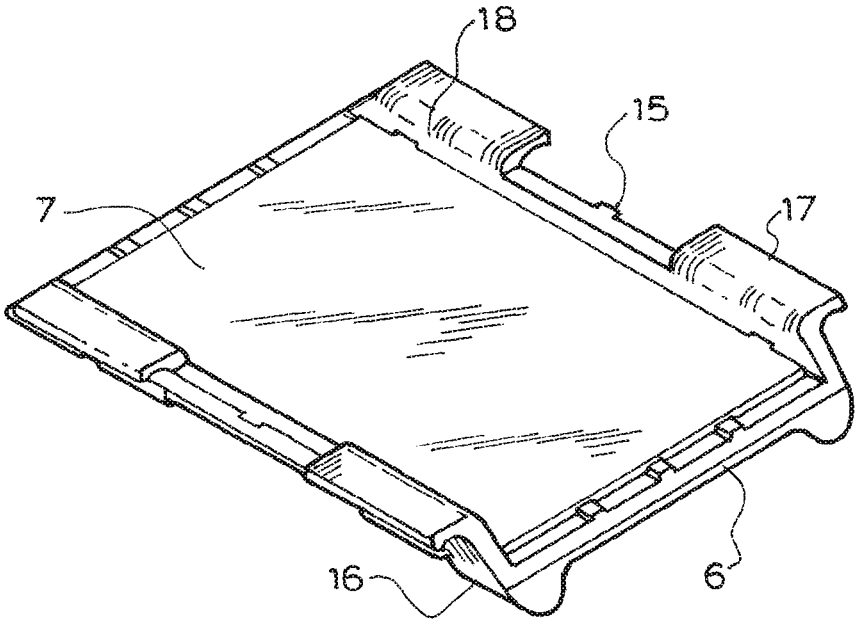
FIG. 5 shows the anti-abrasion plate of this invention.

FIG. 5 shows the anti-abrasion plate assembly. The anti-abrasion plate 6 has the bottom rib 16 which fits in the concrete rail seat recess 10, and side post wall 18 which supports the rail laterally and rests against concrete rail seat wall 11.

Figure 6:
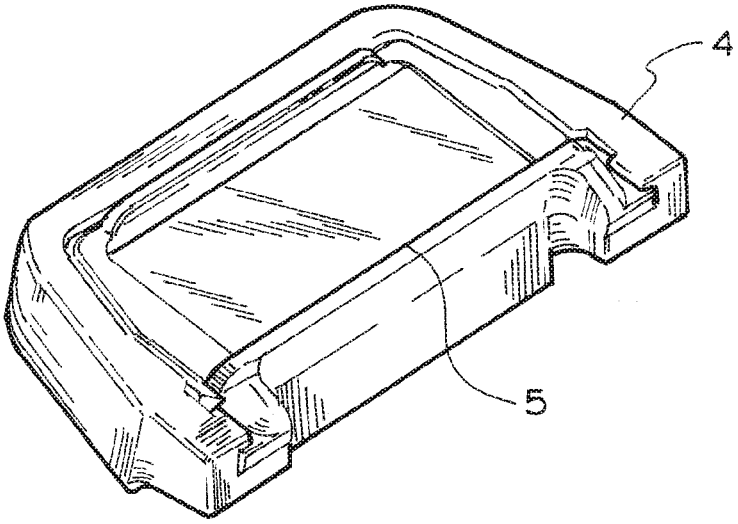
FIG. 6 shows the heavy duty toe insulator.

FIG. 6 shows the heavy duty toe insulator. The steel insert 5 is snapped into the plastic liner 4. The thickness from the bottom of the insulator to the top is 20 mm, this dimension allows the clip to deflect and provide proper clamping force.

From the above it can be seen that the present invention provides an arrangement that reduces the need for maintenance. Testing of these ties to AREMA wear and abrasion standards show that they perform well under load. The full bearing aspects of the seat allows for reduced pressure on the components and they last much longer than conventional elastic fasteners. The rail roads can continue to use their conventional equipment to install, remove and maintain these ties without having to order specialty tools or change their standard operation procedures.

Those skilled in the art will also appreciate that this invention may be implemented in embodiments other than those described without departing from the core teaching of the invention.

The invention claimed is:

1. A rail seat comprising:

a rail tie;

a rail anti-abrasion plate;

an elastic rail clip; and a rail clip support shoulder;

wherein the rail tie has a recessed rail seat with additional recesses to accommodate ribs on a surface of said anti-abrasion plate, said ribs being configured to seat in the additional recesses and provide a wider lateral support for the rail and retard longitudinal movement, wherein a first one of said ribs extends in a first direction towards a first one of said additional recesses, the first direction being normal to a face of the recessed rail seat.

2. A rail seat as claimed in claim 1 wherein said rail clip support shoulder has a rib which sits flush with the recessed rail seat to allow the anti-abrasion plate and the rail tie to provide lateral full bearing to the rail.

3. A rail seat as claimed in claim 2 wherein the rail clip support shoulder has a rectangular recess which interlocks with the anti-abrasion plate to hold it in place before and during track installation.

4. A rail seat as claimed in claim 1 wherein the anti-abrasion plate has four flanges which wrap around the top of the rail tie to prevent dust particles from entering and abrading the recessed rail seat.

5. A rail seat as claimed in claim 4 wherein the flanges also wrap around the rail clip support shoulder for additional resistance to longitudinal movement.

6. A rail seat as claimed in claim 1 wherein the rail clip support shoulder includes a rib protruding from a surface of the rail clip support shoulder.

7. A rail seat as claimed in claim 6 wherein the rail clip support shoulder includes a recess formed in the surface of the rail clip support shoulder.

8. A rail seat as claimed in claim 1 wherein the rail clip support shoulder has a rectangular recess formed in a surface of the rail clip support shoulder, and wherein the anti-abrasion plate includes a lip that protrudes from the anti-abrasion plate into the rectangular recess.

9. A rail seat as claimed in claim 1 wherein the rail seat includes a pair of rail clip support shoulders, and wherein the additional recesses and the ribs are provided between the pair of rail clip support shoulders.

10. A rail seat comprising:

a rail tie;

a rail anti-abrasion plate;

an elastic rail clip; and a pair of rail clip support shoulders;

wherein the rail tie includes a rail seat and a plurality of recesses, each of the plurality of recesses being configured to receive a rib extending from a surface of said anti-abrasion plate at a position between the pair of rail clip support shoulders.

11. A rail seat as claimed in claim 10 wherein said rail clip support shoulder has a front rib which sits flush with the recessed rail seat to allow the anti-abrasion plate and the rail tie to provide lateral full bearing to the rail.

12. A rail seat as claimed in claim 11 wherein each of the plurality of rail clip support shoulders includes a rectangular recess configured to interlock with the anti-abrasion plate.

13. A rail seat as claimed in claim 10 wherein the anti-abrasion plate includes four flanges, each of the four flanges being wrapped around a surface of the rail tie.

14. A rail seat as claimed in claim 13 wherein each of the four flanges is further arranged to wrap around at least one rail clip support shoulder of the pair of rail clip support shoulders.

15. A rail seat as claimed in claim 10 wherein each rail clip support shoulder of the pair of rail clip support shoulders includes a rib protruding from a surface of the rail clip support shoulder.

16. A rail seat as claimed in claim 15 wherein each rail clip support shoulder of the pair of rail clip support shoulders further includes a recess formed in the surface of the rail clip support shoulder.

17. A rail seat as claimed in claim 10 wherein each rail clip support shoulder of the pair of rail clip support shoulders includes a rectangular recess.

18. A rail seat as claimed in claim 10 wherein the anti-abrasion plate further includes a pair of lips, each lip of the pair of lips being received in a respective rectangular recess of a respective rail clip shoulder of the pair of rail clip support shoulders.

19. A rail seat as claimed in claim 10 wherein the ribs have a curved shape that forms a bottom surface of each rib.

20. A rail seat as claimed in claim 19 wherein the anti-abrasion plate has an outermost edge extending outwardly with respect to the additional recesses and outwardly with respect to the ribs.

* * * * *